United States Patent [19]

Katsushige et al.

[11] 4,357,134

[45] Nov. 2, 1982

[54] FUEL COMBUSTION METHOD AND BURNER FOR FURNACE USE

[75] Inventors: Matsuzaki Katsushige, Kisarazu; Narazaki Seiji, Kimitsu; Kawaguchi Masanori, Kisarazu, all of Japan

[73] Assignee: Nippon Steel Corporation, Tokyo, Japan

[21] Appl. No.: 274,053

[22] Filed: Jun. 15, 1981

Related U.S. Application Data

[63] Continuation of Ser. No. 54,570, Jul. 3, 1979, abandoned.

[30] Foreign Application Priority Data

Jul. 11, 1978 [JP] Japan ..... 53-83607

[51] Int. Cl.[3] ..... F23M 3/00

[52] U.S. Cl. ..... 431/9; 431/115; 431/181; 431/188

[58] Field of Search ..... 431/8, 9, 181, 187, 431/188, 115, 190, 351; 239/424.5, 424, 433

[56] References Cited

U.S. PATENT DOCUMENTS 2,242,797 5/1941 Lucke ..... 431/9
3,984,196 10/1976 Zenkner ..... 431/202
4,035,137 7/1977 Arand ..... 431/115

FOREIGN PATENT DOCUMENTS 930589 7/1963 United Kingdom ..... 431/190

*Primary Examiner*—Carroll B. Dority, Jr.
*Attorney, Agent, or Firm*—Wenderoth, Lind & Ponack

[57] ABSTRACT

A method and apparatus are provided for burning fuel, with controlled NOx formation, in a burner-fired furnace. A fuel injection port is provided in the furnace, surrounded by a plurality of air injection ports. The fuel and combustion air are injected in such a manner as to minimize their contact in a burner tile port. The injected air establishes a vacuum within the burner tile port. The spent gas is drawn to near the fuel and air injection ports along the cylindrical surface of the burner tile port. The drawn spent gas encloses the fuel and air streams in the burner tile port. Primary combustion of the fuel is achieved by using mainly the oxygen contained in the enclosing spent gas. Secondary combustion is effected by bringing in contact the streams of the combustion air and fuel in the furnace into which burner the tile port opens.

4 Claims, 19 Drawing Figures

FUEL COMBUSTION METHOD AND BURNER FOR FURNACE USE

This application is a continuation of application Ser. No. 54,570 filed Jul. 3, 1979, abandoned.

BACKGROUND OF THE INVENTION

This invention relates to a method and burner for burning fuel in a furnace. More particularly, it relates to a method and burner for burning fuel with controlled NOx formation.

Generally, NOx-formation-inhibiting burners (hereinafter called low-NOx burners) for use in metal heating furnaces are classified as the double combustion type, spent-gas recirculation type, steam injection type, and so on. The double combustion system performs primary combustion with a relatively small amount of air, then secondary combustion with abundant air. The spent-gas recirculation system dilutes the air and/or fuel with the spent gas introduced from the furnace to the burner tile port. The steam injection type dilutes the air and/or fuel with steam, instead of the spent gas, injected into the burner tile port.

All these conventional low-NOx burners are large, complex, costly, and difficult to maintain.

This invention is based on the spent-gas recirculation system. Conventional burners of this type, for example, have suffered from the following difficulties. Introduction of the spent gas to the burner tile port has necessitated a complex structure. More specifically, the spent gas in the furnace is drawn to the burner tile port through a lead-in port provided in the furnace wall. Or, the spent gas drawn from the furnace is forcibly supplied to the burner tile port with a fan. With such structures, the conventional low-NOx burners unavoidably become large, complex and difficult to maintain and inspect.

Modification of a conventional ordinary burner to the low-NOx type calls for much cost and long furnace shutdown. Therefore, there has been a large demand for a small, simple, low-maintenance-cost fuel burning method and burner with high NOx-controlling ability.

SUMMARY OF THE INVENTION

This invention has solved the aforementioned problems with the conventional low-NOx burners. The object of this invention is to provide an efficient method of burning fuel in a furnace using a simple, small, lightweight burner, to which conventional burners can be modified easily.

To achieve the above object, the furnace fuel burning method according to this invention comprises injecting the fuel and air from a fuel injection port and a plurality of air injection ports, surrounding the fuel port, in such a manner as to minimize their contact in a burner tile port. The injected air establishes a vacuum within the burner tile port, whereby the spent gas in the furnace is drawn to near the fuel and air injection ports along the cylindrical surface of the burner tile port. The drawn spent gas encloses the fuel and air streams in the burner tile port.

To effectively carry out the above-described burning method, the burner according to this invention keeps the positional relationship between the air and fuel injection ports and the minimum distance between the injected air stream and the periphery of the burner tile port within certain limits.

The fuel burning method and burner of this invention accelerate self-circulation of the high-temperature spent gas from the furnace into the burner tile. Enclosed with this spent gas, the air and fuel streams are prevented from prompt contact. At the same time, primary combustion takes place at the surface of the fuel stream, utilizing the residual oxygen (usually ranging from 4 to 5 percent) in the high-temperature spent gas enclosing the fuel stream. Then, with the lapse of time, this primary combustion gas and the spent gas enclosing the air stream gradually mix with the inside air. With this air having a lowered $O_2$ partial pressure, secondary combustion proceeds slowly, without lowering the flame temperature. Consequently, the oxidizing reaction of nitrogen is held at a very low level.

BRIEF DESCRIPTION OF THE DRAWINGS

FIG. 3 being a cross-sectional view and FIG. 4 a cross-section taken along the line IV—IV of FIG. 3.

DETAILED DESCRIPTION OF THE PREFERRED EMBODIMENTS

Figure 1:
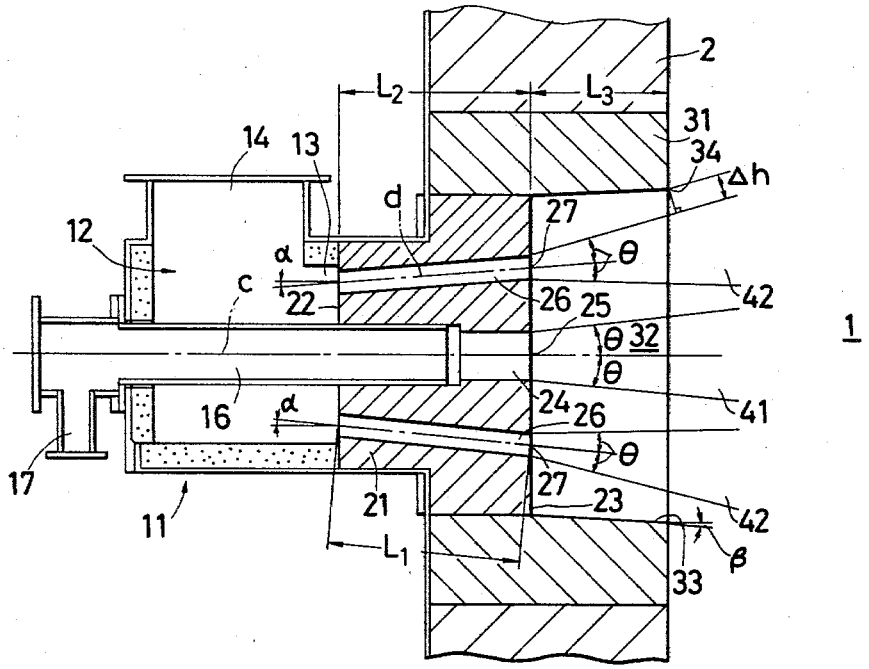
FIG. 1 is a cross-sectional view showing a burner embodying this invention.

FIG. 1 shows a burner that embodies this invention. This burner 11 comprises a body 12, with the front end of a cylindrical portion 13 thereof tightly covered with a refractory baffle 21. The rear portion of the body 12 communicates with a wind box 14 that supplies the combustion air to the cylindrical portion 13.

The front portion of the baffle 21 is tightly fitted in the rear or outer portion of a burner tile 31 fastened to a furnace wall 2. A fuel tube 16 is inserted from the rear end of the burner body 12, coaxially with the cylindrical portion 13 thereof. The fuel tube 16 at a rear end thereof communicates with a fuel supply pipe 17 and at a front end thereof reaches the center of the baffle 21. The front surface 23 of the baffle 21 is either flat or substantially flat.

Figure 2:
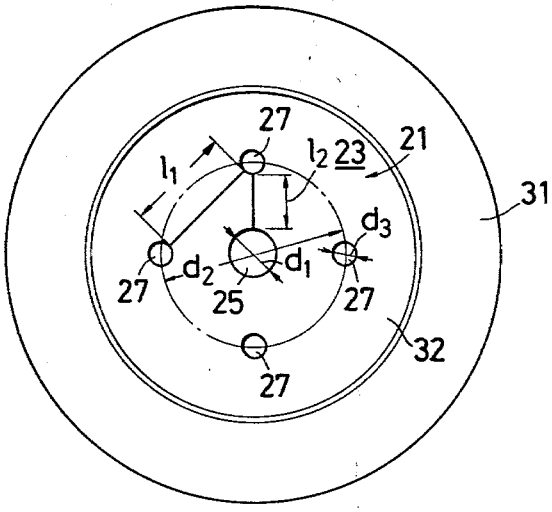
FIG. 2 is a front view of the burner shown in FIG. 1.

The baffle 21 has a fuel injection port 24 provided along the central axis c of the burner 11 so as to extend the fuel tube 16. The baffle 21 is also provided with a plurality of air injection ports 26 passing from the rear end 22 to the front end 23 thereof. The air injection ports 26 are provided so that their orifices 27 are radially disposed around an orifice 25 of the fuel injection port 24, as shown in FIG. 2. The axis d of each air injection port 26 is inclined at an angle of 0 to 5 degrees with respect to the central axis c of the burner 11 so as diverge forwardly This angle is hereinafter called the air injection port inclination angle $\alpha$.

A port 32 in the burner tile 31 is shaped like a truncated cone diverging toward the inside of a furnace 1. The angle $\beta$ at which the peripheral surface 33 of the port 32 inclines with respect to the central axis c of the burner 11 ranges between approximately 0 and 10 degrees.

The following sentences describe the method and conditions for carrying out low-NOx combustion with the above-described burner of this invention.

Figure 3:
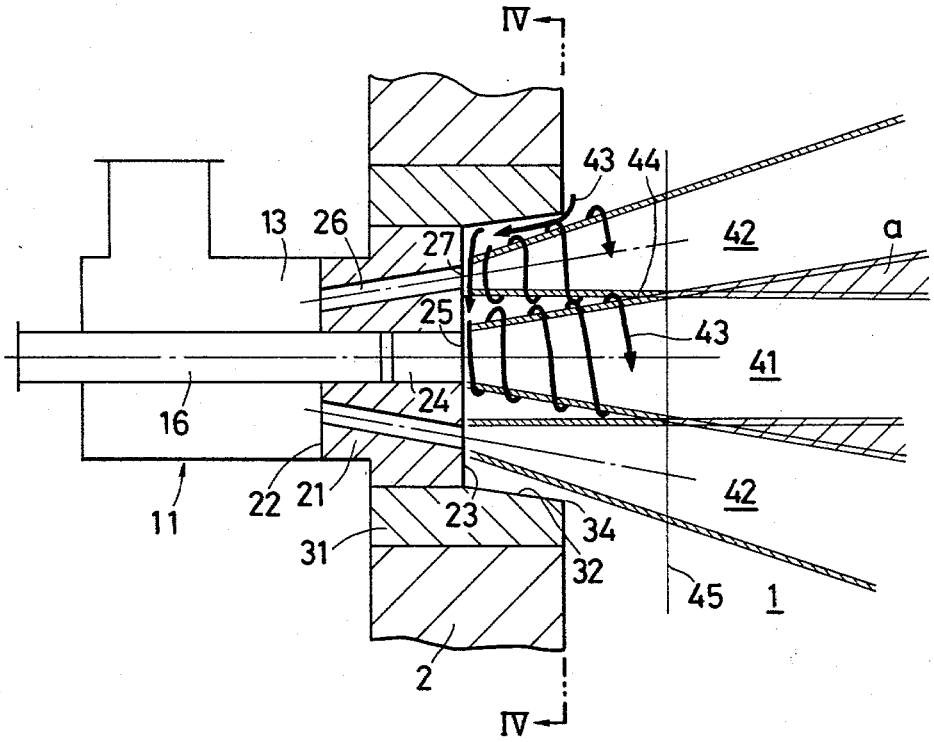
FIGS. 3 and 4 schematically illustrate the combustion method according to this invention.
Figure 4:
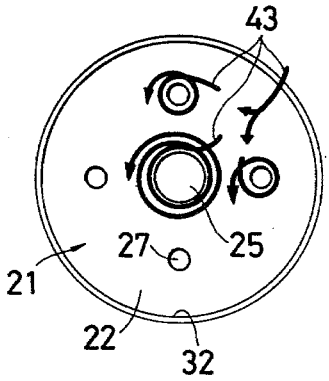

FIGS. 3 and 4 illustrate the principle of burning fuel with low NOx formation, which depends on the recirculation of the spent gas in the furnace 1 to the burner tile port 32.

The fuel (e.g., coke oven gas) and the combustion air, forcibly supplied to the fuel tube 16 and burner body 12, are divergingly injected from the orifices 25 and 27, respectively. The injection angle $\theta$, at which an injected fuel stream 41 and an injected air stream 42 diverge with respect to their respective port axes, has experimentally been established as nine degrees. The sizes $d_1$ and $d_3$ of the fuel injection port 25 and each air injection port 26, positional relationships $d_2$, $l_1$ and $l_2$ thereamong, and the air injection port inclination angle $\alpha$ are determined so as to minimize the contact between the fuel stream 41 and the air stream 42 in the tile port 32. (For reference characters, see FIG. 2.)

When the fuel and air are being injected, the ejecting effect due to their injection energy establishes a vacuum inside the tile port 32, whereby the high-temperature spent gas 43 in the furnace 1 is drawn from the exit end 34 of the tile 31 to the front end 23 of the baffle 21 along the peripheral surface 33 of the tile port 32. (This movement is hereinafter called the "self-recirculation of the spent gas.")

On reaching the front end 23 of the baffle 21, the high-temperature spent gas 43 flows therealong to enclose the fuel stream 41 and air streams 42 in the tile port 32. Primary combustion takes place at the surface 44 of the fuel stream 41 up to a point 45 where the fuel stream 41 and air streams 42 contact, utilizing the residual oxygen (usually ranging from 4 to 5 percent) in the high-temperature spent gas enclosing the fuel stream 41. The result is the mixing of the primary combustion gas and fuel. Meanwhile, the high-temperature spent gas enclosing the air streams 42 increasingly mixes with the air to lower the $O_2$ partial pressure therein, up to the point 45 where the fuel stream 41 and air streams 42 meet. Accordingly, the fuel stream 41 and air streams 42 are restrained from mixing and burning immediately after they leave the fuel injection port 25 and air injection ports 27.

Beyond the contact point 45, the primary combustion gas and air with reduced $O_2$ partial pressure mix directly and start secondary combustion at point a. Therefore, the air injection ports 26 appear to emit individual flames at this point a, four such flames being seen in this embodiment.

With the oxygen concentration in the air being low and part of the fuel having been burnt, combustion proceeds slowly without lowering the flame temperature. Consequently, formation of NOx is heavily restrained. To maintain such low-NOx combustion, self-recirculation of the spent gas into the burner tile must be abundant enough to fully enclose the fuel stream 41 and air streams 42. The amount of the self-recirculation depends on a gap $\Delta h$ between the air stream 42 and the exit end 34 of the burner tile 31.

Figure 5:
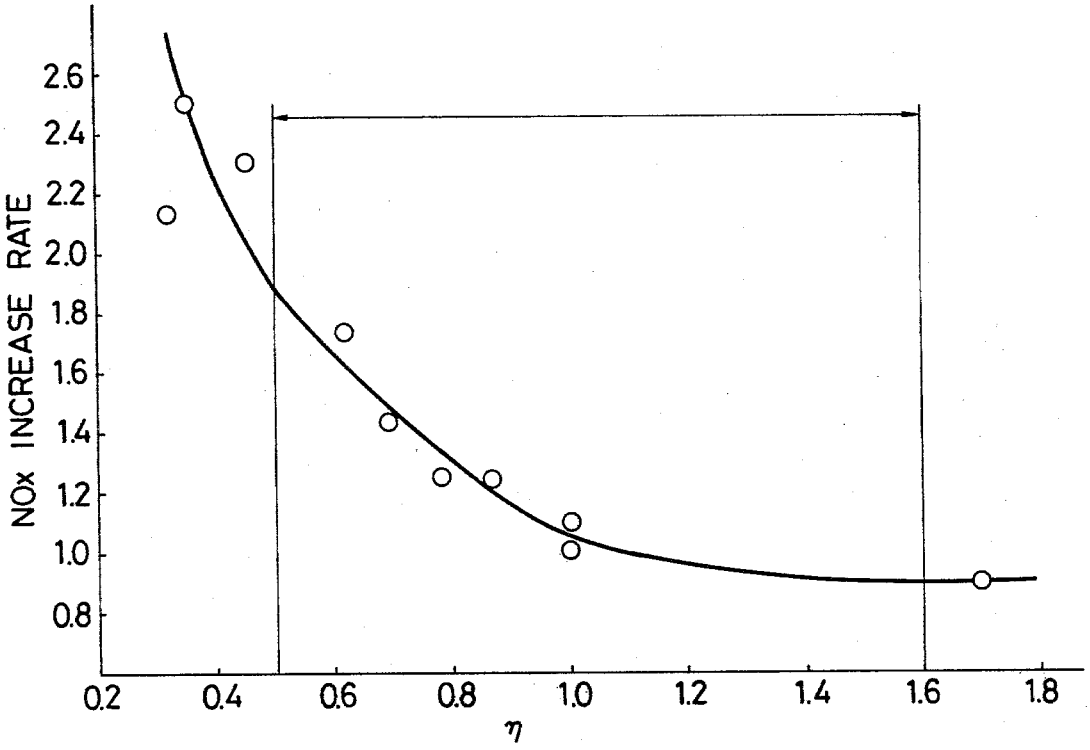
FIG. 5 is a graph plotting the relationship between burner characteristic $\eta$ and NOx increase rate.

It has been also confirmed by model experiments that the spaces among the individual air injection ports 27 and between each air injection port 27 and the fuel injection port 25 must be large enough to permit the spent gas to independently enclose the fuel and air streams in the burner tile 31. If Q is the burning capacity (Kcal/hr) of a burner and the characteristic of the burner $\eta$ is defined as $\eta=0.1174(l_1\times l_2)Q^{-\frac{1}{2}}$, the relationship between $\eta$ and NOx increase rate is established as shown in FIG. 5. In the above equation, $l_1$ is the minimum distance between the peripheries of two adjacent air injection ports 27, and $l_2$ is the minimum distance between the peripheries of an air injection port 27 and the fuel injection port 25, both on the front end 23 of the baffle 21.

As seen in FIG. 5, NOx decreases as the value of $\eta$, or the product of $l_1\times l_2$ (Q=constant), increases.

It is true that NOx decreases with increasing $\eta$, but excessive increase in $\eta$ results in a delayed mixture of the fuel and air and, therefore, an instable combustion. The inventors have experimentally established that the favorable value of $\eta$ for the maintenance of stable combustion should not exceed 1.6.

Conversely, NOx increases with decreasing $\eta$, especially when $\eta$ becomes smaller than 0.5. To maintain stable combustion while controlling the NOx formation at a low level, therefore, $\eta$ should be held within the range of 0.5 to 1.6.

Figure 6:
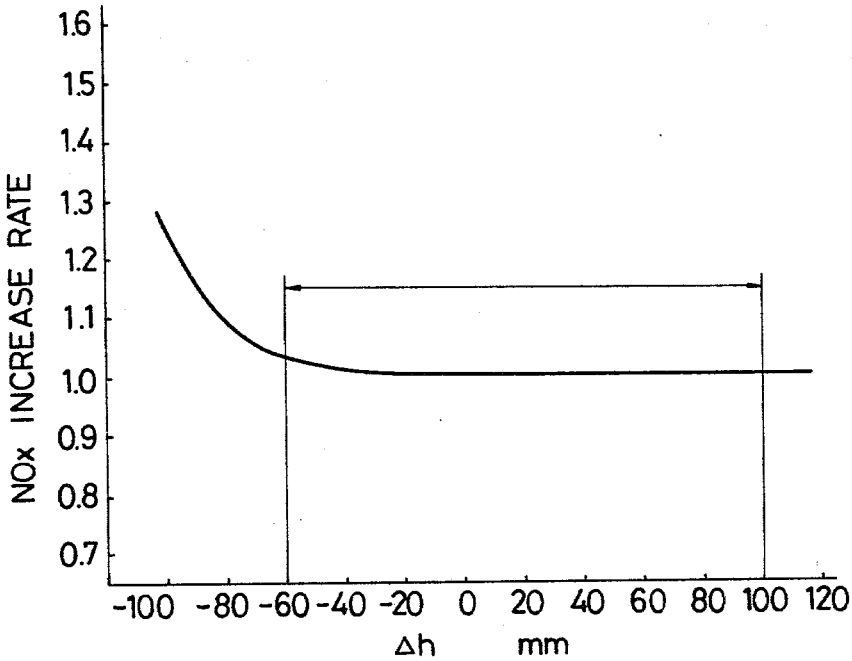
FIG. 6 is a graph plotting the relationship of minimum distance $\Delta h$ between the air stream and the periphery of the burner tile port with NOx increase rate.

FIG. 6 plots the relationship between NOx increase rate and the minimum distance $\Delta h$ between the burner tile and a plane diverging at an angle of nine degrees with respect to the axis of the air injection port from the exit end thereof on the baffle surface.

When $\Delta h$ falls below $-60$ mm, NOx increases sharply. When $\Delta h$ exceeds 100 mm, combustion becomes unstable. In extreme cases, flames are blown off. To maintain stable, low-NOx combustion, or the optimum self-recirculation of the spent gas, $\Delta h$ should be held between $-60$ and 100 mm.

The inventors have also experimentally established that the formation of NOx depends on $\Delta h$, independently of the depth $L_3$ of the burner tile port. Thus not being an absolute requisite for the maintenance of stable combustion, the depth $L_3$ of the burner tile port should favorably be larger than 100 mm. But the port depth $L_3$ must be kept within the thickness of the furnace wall 2, since excess increase thereof results in an increase in the burner size.

Figure 7:
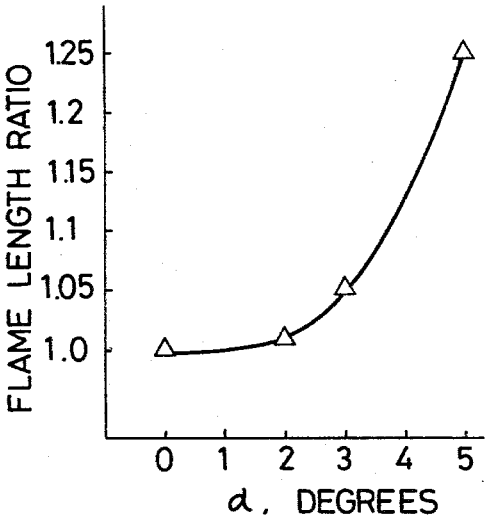
FIG. 7 is a graph plotting the relationship between angle $\alpha$ at which the air injection port inclines and flame length ratio.
Figure 8:
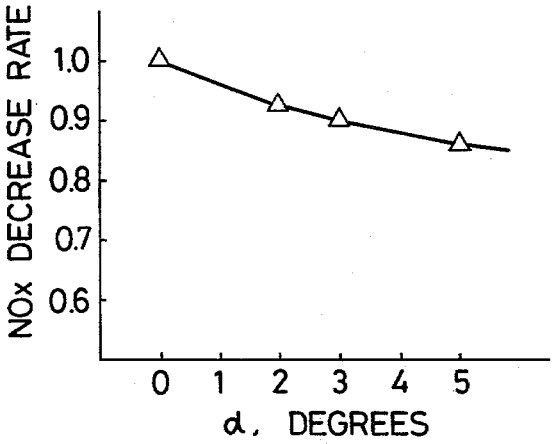
FIG. 8 is a graph plotting the relationship between angle $\alpha$ at which the air injection port inclines and NOx decrease rate.

FIG. 7 shows the relationship between the air injection port inclination angle $\alpha$ and flame length ratio. FIG. 8 shows the relationship between the air injection port inclination angle $\alpha$ and NOx reduction rate. The flame length ratio in FIG. 7 is the ratio of a flame length at each different inclination angle $\alpha$ to the flame length at $\alpha=0$. As is evident from FIG. 7, the flame length increases and the temperature near the burner wall decreases as the air injection port inclination angle $\alpha$ increases, because the contact point (indicated by reference numeral 45 in FIG. 3) of the fuel and air streams recedes from the burner. But, as seen from FIG. 8, the increasing inclination angle $\alpha$ has a greater effect on the control of NOx formation. Accordingly, the air injection port inclination angle $\alpha$ may be selected with consideration of such flame properties as flame length and temperature. But an excessively large inclination angle $\alpha$ may result in unstable combustion or blow-off of the flames. The practical inclination angle $\alpha$ is, therefore, between 0 and 5 degrees. The length $L_1$ of the air injection port 27 perforated through the baffle 21 must be large enough so that the air injected therefrom can be substantially rectified by the baffle 21. If the diameter of the air injection port 27 is $d_3$, the thickness $L_2$ of the baffle 21 is usually selected so that the ratio $L_1/d_3$ is larger than 2. Since an excessive increase in the ratio $L_1/d_3$ increases the burner size, the practical ratio $L_1/d_3$ should be kept below 10.

Now several embodiments of the burner according to this invention will be described, which were put to commercial tests using a soaking-pit furnace having a nominal heating capacity of 150-ton per pit. Details of the burners are shown in Table 1. The conventional ordinary burner given in Table 1 does not perform low-NOx combustion.

Three charges or 450 tons of steel ingots were heated under the following combustion conditions, using the burners shown in Table 1, and the obtained results were compared.

| | |
|---|---|
| No. of burner | 2 |
| Burner capacity | $600 \times 10^4$ Kcal/hr per burner |
| Fuel | Coke oven gas (4,600 Kcal/Nm$^3$) |
| Furnace temperature setting | 1,300° C. |
| Preheating air temperature | 420° C. |
| Spent gas temperature | 1,000° C. |
| Oxygen content in spent gas | 2% |

TABLE 1

Figure 9:
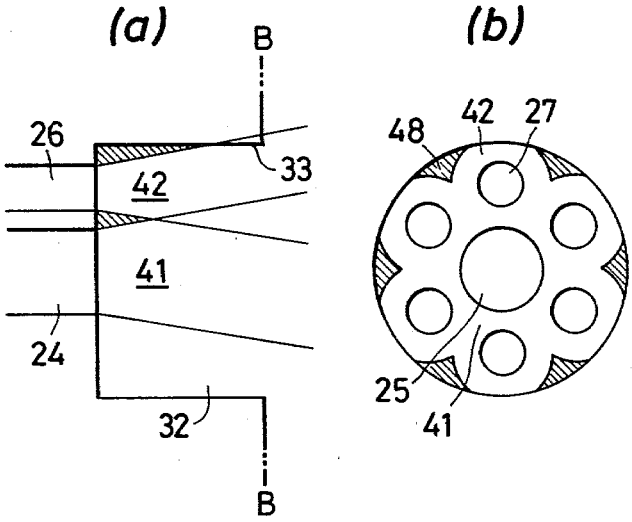
FIGS. 9 through 13 schematically illustrate the combustion conditions with a conventional burner of the ordinary type, and embodiments I, II, III and IV of this invention; each figure consisting of a cross-sectional view (a) and another cross-sectional view (b) taken along the long B—B of (a).
Figure 10:
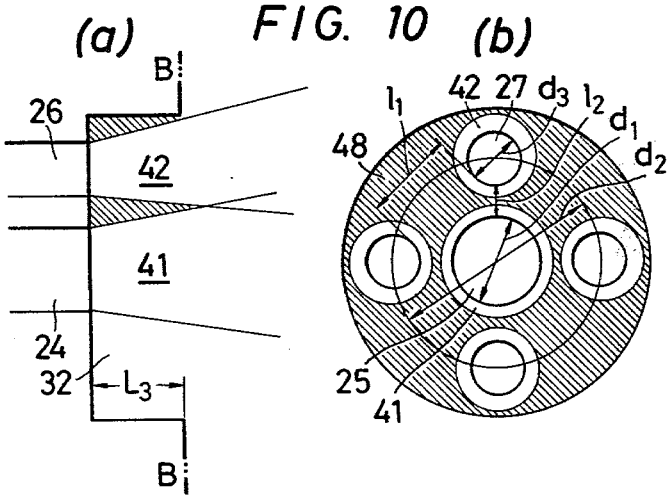
Figure 11:
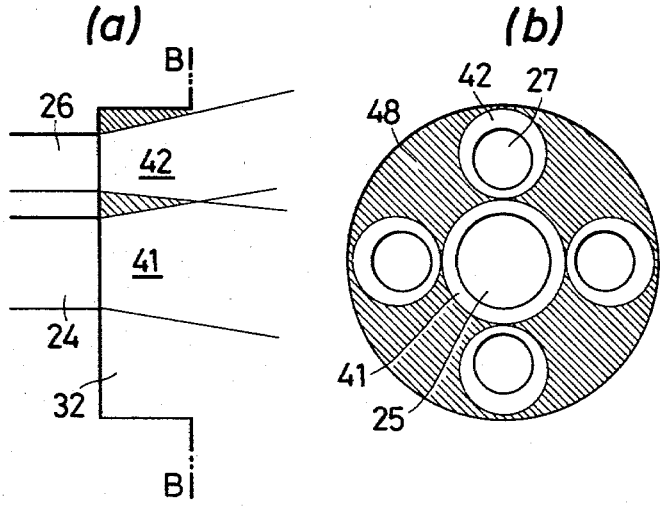
Figure 12:
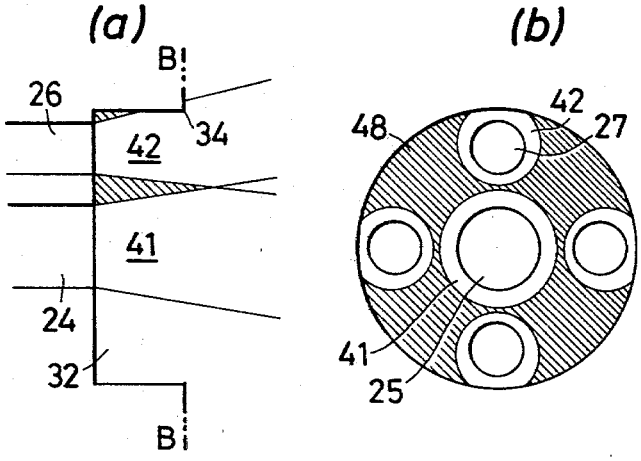
Figure 13:
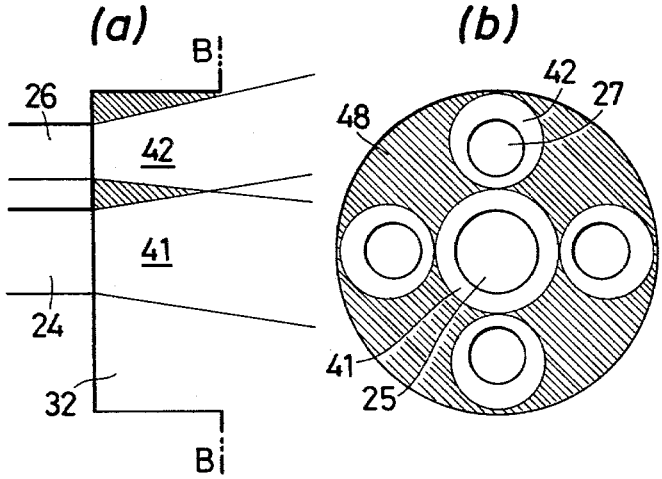

| | Details of Burners | | | | |
|---|---|---|---|---|---|
| | C.O. | Embodiments of This invention | | | |
| Description | Burner | I | II | III | IV |
| No. of air injection port | 6 | 4 | 4 | 4 | 4 |
| Air injection port inclination angle $\alpha$ (degree) | 0 | 3 | 3 | 3 | 3 |
| Diameter $d_1$ (mm) | 230 | 230 | 250 | 230 | 230 |
| Distance $d_2$ (mm) | 455 | 553 | 553 | 553 | 553 |
| Diameter $d_3$ (mm) | 125 | 150 | 163 | 150 | 150 |
| $\eta$ | 0.246 | 1.0 | 0.765 | 1.0 | 1.0 |
| Burner tile depth $L_3$ (mm) | 450 | 250 | 250 | 250 | 350 |
| Burner tile diameter (in wall section) (mm) | 683 | 830 | 830 | 750 | 872 |
| Burner tile diverging angle (degree) | 0 | 0 | 0 | 0 | 0 |
| $\Delta h$ (mm) | −20 | 10 | 10 | −30 | 10 |
| Relevant FIG. No. | FIG. 9 | FIG. 10 | FIG. 11 | FIG. 12 | FIG. 13 |

Note. C.O. Burner = Conventional ordinary burner

FIGS. 9 through 13 schematically illustrate the combustion conditions with the conventional ordinary burner and embodiments of this invention.

Figure 14:
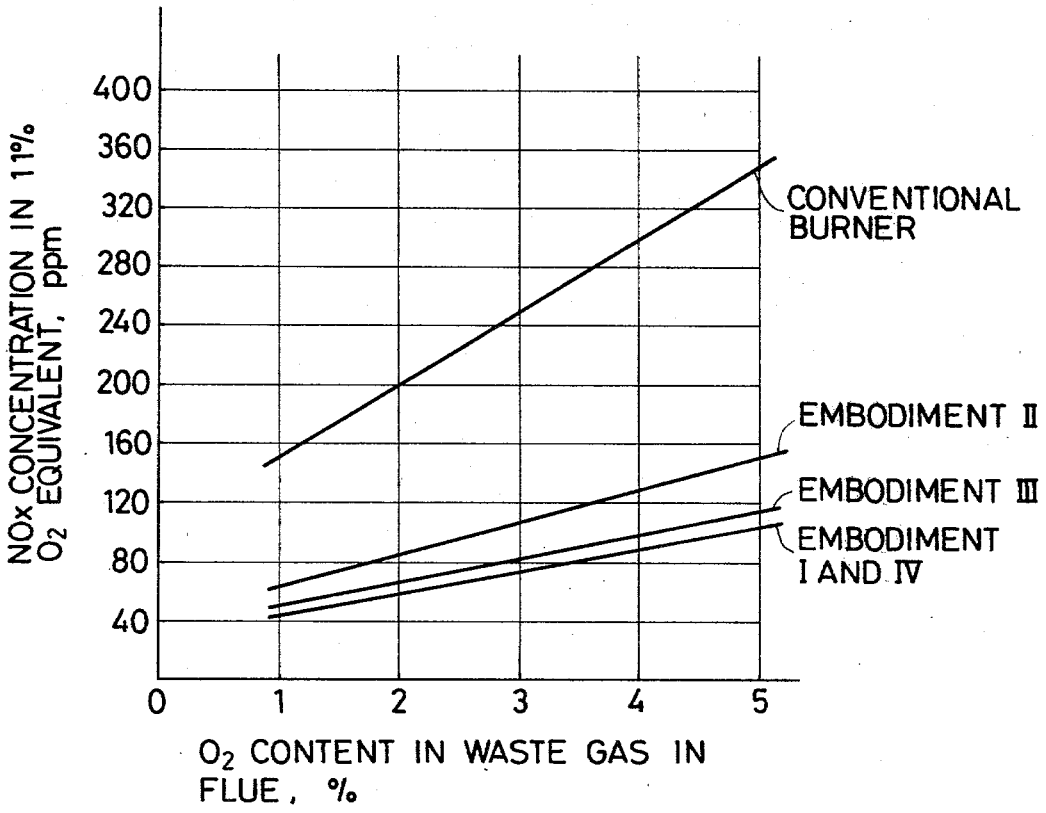
FIG. 14 is a graph plotting the relationship between $O_2$ and NOx concentrations in the waste gas in the furnace flue, for the conventional burner and embodiments of this invention.

FIG. 14 is a graphical representation of the experimental results with the embodiments of this invention, plotting the relationship between the oxygen and NOx concentrations in the waste gas in the furnace flue. As is evident from the graph, NOx concentrations obtained by the embodiments I and IV are as low as approximately 30 percent of that for the conventional ordinary burner. Though approximately 30 and 10 percent higher than the level of the embodiment I, NOx concentrations resulted from the embodiments II and III, also, are within practically tolerable limits.

In FIGS. 9 through 13, hatched portions indicate gaps. FIG. 9 shows a case of the conventional ordinary burner. As seen, there is a gap 48 between the air stream 42 and the peripheral tile port surface 33, in which the air stream 42 provides turbulence to the atmosphere. Consequently, this burner cannot draw as much spent gas into the tile port 32 as is enough for achieving the same effect as is expectable of this invention.

FIGS. 10 through 13 illustrate the combustion conditions with the embodiments of this invention, in all of which the gap 48 is large enough to permit the drawing of abundant spent gas into the tile port 32. Especially, FIG. 12 shows a case in which the minimum distance $\Delta h$ is negative. Even with the negative $\Delta h$, an adequate quantity of spent gas is drawn into the tile port 32 from the burner tile exit end 34 between the circumferentially adjacent air streams 42.

As will be understood from the above description, the fuel burning method according to this invention permits burning fuel with markedly reduced NOx formation, using a burner whose structure is as simple as that of the conventional ordinary burner. Further, the burning method of this invention does not lower the flame temperature in the vicinity of the burner tile, as is experienced with the conventional low-NOx burners. Thus assuring uniform heating throughout a furnace, the method of this invention is suited, for example, for the soaking-pit furnaces whose function is to uniformly heat steel ingots, etc.

The burning method and burner of this invention can be used for such fuels as coke oven gas, fuel oil and pulverized coal as have or can be injected in a fluid form. They are adaptable to batch-type, continuous and other types of heating furnaces.

What is claimed is:

1. A method of burning fuel in a furnace having a furnace wall including a burner tile with a port therethrough, and a burner including a baffle extending into an outer portion of said port, said baffle not extending into an inner portion of said port, a fuel injection port extending through said baffle along a central axis of said burner and opening into said inner portion of said port, and a plurality of air injection ports extending through said baffle at positions circumferentially spaced about said fuel injection port and opening into said inner portion of said port, said method comprising:

injecting fuel through said fuel injection port in a fuel stream along said central axis through said inner portion of said port of said burner tile and into the interior of said furnace;

simultaneously injecting combustion air through said plurality of air injection ports in respective air streams diverging outwardly from said central axis through said inner portion of said port of said burner tile and into said interior of said furnace;

maintaining said air streams substantially out of contact with each other, with said fuel stream and with said burner tile during passage thereof through said inner portion of said port of said burner tile;

developing a reduced pressure within said inner portion of said port of said burner tile by injection therethrough of said fuel and air streams, drawing spent gas from said interior of said furnace into said inner portion of said port of said burner tile along the periphery thereof by means of said reduced pressure, and enclosing said fuel and air streams within said inner portion of said port of said burner tile with said spent gas;

performing primary combustion of said fuel in said fuel stream within said inner portion of said port of said burner tile with oxygen contained in said spent gas enclosing said fuel stream; and bringing said air streams into contact with said fuel stream within said interior of said furnace, and thereat performing secondary combustion therebetween.

2. A burner for use with a furnace, said burner comprising:

a burner tile adapted to be positioned within a wall of a furnace, said burner tile having therethrough a port;

a baffle extending into an outer portion of said port of said burner tile, said baffle not extending into an inner portion of said port of said burner tile, said baffle having an inner surface facing said inner portion;

a fuel injection port extending through said baffle along a central axis of said burner and opening on said inner surface into said inner portion;

a plurality of air injection ports extending through said baffle at positions circumferentially spaced about said fuel injection port and opening on said inner surface into said inner portion in directions diverging from said central axis;

a body connected to said baffle at a position outwardly of said burner tile, outer ends of said air injection ports opening into the interior of said body;

fuel supply means connected to said fuel injection port for injecting therethrough a fuel stream along said central axis through said inner portion of said port of said burner tile and into the interior of a furnace to be associated therewith;

air supply means connected to said body for supplying combustion air from said interior thereof through said air injection ports in air streams through said inner portion of said port of said burner tile, such that said air streams do not intersect each other during passage thereof through said inner portion of said port of said burner tile; and said fuel and air injection ports and said port in said burner tile being such that the following relationships exist:

$$0.5 \leqq \eta \leqq 1.6 \text{ and } 100 \text{ mm} \geqq \Delta h \geqq 0 \text{ mm}$$

wherein $\eta = 0.1174\ (l_1 \times l_2) Q^{-\frac{1}{2}}$ $l_1$ = minimum distance (mm) between the peripheries of two circumferentially adjacent said air injection ports on said inner surface of said baffle $l_2$ = minimum distance (mm) between the respective peripheries of said fuel and air injection ports on said inner surface of said baffle Q = burner capacity (Kcal/hr)

$\Delta h$ = minimum distance (mm) between the periphery of the inner exit end of said port of said burner tile and an outer surface of an injected air stream diverging from the periphery of the respective said air injection port at an angle of nine degrees with respect to the axis of said air injection port, said air stream thus being in the form of a truncated cone.

3. A burner as claimed in claim 2, wherein the depth of said inner portion of said port of said burner tile is not less than 100 mm and not greater than the thickness of the furnace wall.

4. A burner as claimed in claim 2, wherein the length to diameter ratio of each said air injection port is not less than two and not greater than ten.

* * * * *